US012520956B2

(12) United States Patent
Henry et al.

(10) Patent No.: US 12,520,956 B2
(45) Date of Patent: Jan. 13, 2026

(54) PASS-THROUGH LOSS PREVENTION SYSTEM

(71) Applicant: Trinity LLC, Metuchen, NJ (US)

(72) Inventors: Eric Henry, Bound Brook, NJ (US); John Farinola, Monroe Township, NJ (US)

(73) Assignee: Trinity LLC, Metuchen, NJ (US)

( * ) Notice: Subject to any disclaimer, the term of this patent is extended or adjusted under 35 U.S.C. 154(b) by 0 days.

(21) Appl. No.: 18/738,240

(22) Filed: Jun. 10, 2024

(65) Prior Publication Data

US 2024/0407572 A1 Dec. 12, 2024

Related U.S. Application Data

(60) Provisional application No. 63/472,115, filed on Jun. 9, 2023.

(51) Int. Cl.
*A47F 3/00* (2006.01)
*A47F 7/28* (2006.01)

(52) U.S. Cl.
CPC ..... *A47F 3/002* (2013.01); *A47F 7/286* (2013.01); *A47F 7/28* (2013.01)

(58) Field of Classification Search
CPC .. A47F 3/002; A47F 7/28; A47F 3/007; A47F 2003/008; A47F 3/06; A47F 3/063; A47F 2003/066; A47F 5/0081; A47F 7/286
USPC ..... 211/1, 7, 59.2, 59.3; 312/137, 139, 292, 312/138.1
See application file for complete search history.

(56) References Cited

U.S. PATENT DOCUMENTS 591,739 A * 10/1897 Crandall et al. ..... A47B 63/00 312/292
1,011,112 A * 12/1911 Burlingame ..... A47F 3/005 312/138.1
1,642,533 A * 9/1927 Beer ..... A47G 29/1201 312/292
2,136,558 A * 11/1938 Manshel ..... F25D 23/04 62/266
3,575,478 A * 4/1971 Szobski ..... A47F 3/002 312/117
4,007,853 A * 2/1977 Bahneman ..... A47F 1/08 312/42

(Continued)

*Primary Examiner* — Jennifer E. Novosad
(74) *Attorney, Agent, or Firm* — Gearhart Law LLC

(57) ABSTRACT

A storefront shelf can have a shelf front, a shelf top, a shelf bottom, a right sidewall, and a left sidewall. The shelf front includes a transparent barrier, one or more product exit apertures, one or more product movement apertures, and a set of restocking components. The transparent barrier permits shoppers to view shelf contained products and, when closed, inhibits extraction of any of a set of shelf contained products except through at least one product exit aperture. Each product exit aperture is an opening in the shelf front sufficiently large to permit one of the shelf contained products to pass. The product movement apertures are each opening in the shelf front sufficiently large to permit a hand of the shopper to pass and to thereafter manipulate positions of the shelf contained product(s). The set of restocking components are connected to open and close the transparent barrier. When the transparent barrier is open the shelf contained products can be restocked via the opening.

19 Claims, 9 Drawing Sheets

(56) References Cited

U.S. PATENT DOCUMENTS 4,095,861 A * 6/1978 Kachidurian ..... H05K 7/18 312/351
4,130,326 A * 12/1978 Hornblad ..... A47F 3/002 312/42
4,597,614 A * 7/1986 Alexander ..... A47F 1/08 312/121
4,887,737 A * 12/1989 Adenau ..... G07F 11/42 221/192
D329,159 S * 9/1992 Oldorf ..... 221/92
5,249,855 A * 10/1993 Franklin ..... A47F 3/002 312/139.2
5,269,597 A * 12/1993 Yenglin ..... G07F 9/10 312/138.1
5,447,366 A * 9/1995 Cole ..... A47F 7/14 312/212
5,665,304 A * 9/1997 Heinen ..... A47F 1/126 211/59.3
5,794,817 A * 8/1998 Rosa ..... A47F 1/08 211/49.1
5,797,487 A * 8/1998 Young ..... E05C 19/003 206/307
6,176,558 B1 * 1/2001 Hlade ..... A47F 7/14 221/92
6,351,964 B1 * 3/2002 Brancheau ..... A47F 7/28 211/74
7,150,365 B2 * 12/2006 Hardy ..... A47F 3/002 211/189
7,451,881 B2 * 11/2008 Hardy ..... A47F 5/0018 211/175
7,641,072 B1 * 1/2010 Vlastakis ..... G07G 3/003 221/229
7,828,158 B2 * 11/2010 Colelli ..... A47F 1/126 211/59.3
8,047,385 B2 * 11/2011 Hardy ..... A47B 73/006 211/59.3
8,152,006 B2 * 4/2012 Wamsley ..... A47F 5/005 211/119.003
8,215,520 B2 * 7/2012 Miller ..... A47F 3/002 221/184
8,428,774 B2 * 4/2013 Conti ..... G06F 17/00 221/3
8,727,179 B2 * 5/2014 Colelli ..... G07F 11/38 211/59.3
8,788,091 B2 * 7/2014 Bauer ..... G07F 17/18 700/242
9,038,854 B2 * 5/2015 Brugmann ..... G07F 11/42 221/154
9,119,488 B2 * 9/2015 Lockwood ..... G07G 3/003
9,241,584 B1 * 1/2016 McHatet ..... A47F 3/14
10,352,092 B2 * 7/2019 DeGraaf ..... E06B 5/006
10,638,855 B2 * 5/2020 Cichuta ..... A47F 10/06
11,357,341 B2 * 6/2022 Ewing ..... A47F 3/002
11,412,863 B2 * 8/2022 Grant ..... A47F 3/002
11,426,013 B2 * 8/2022 Pena ..... A47F 3/043
D965,355 S * 10/2022 Fink ..... D6/672
11,540,628 B2 * 1/2023 Brück ..... G08B 13/1436
11,700,939 B2 * 7/2023 Bailey ..... A47B 67/02 312/294
11,910,937 B2 * 2/2024 Gulick, Jr. ..... A47B 73/00
2004/0232092 A1 * 11/2004 Cash ..... A47B 73/008 211/74
2008/0283477 A1 * 11/2008 Wamsley ..... A47F 3/002 211/153
2011/0163113 A1 * 7/2011 Grubbs ..... A47F 1/125 221/311
2011/0220597 A1 * 9/2011 Sherretts ..... A47F 1/128 211/59.3
2012/0200215 A1 * 8/2012 Marzaro ..... A47F 3/0469 312/408
2023/0233000 A1 * 7/2023 Welsh ..... A47F 1/126 312/114
2024/0407572 A1 * 12/2024 Henry ..... A47F 3/002

* cited by examiner

Single Shelf Integrated on Adjustable Rack Mounting

Shelf with Variable Sized Exist/Movement Aperture

DETERGENT PASS-THROUGH,FRAME SYSTEM

HOW TO SHOP PRODUCT CLOSE-UP

STEP-1: Reach in through oval cut-out and bring product onto front glide rail

STEP-2: Slide bottle over to exit well on either side

STEP-3: Angle and remove bottle out of the exit well

PASS-THROUGH LOSS PREVENTION SYSTEM

CROSS-REFERENCE TO RELATED APPLICATIONS

This application claims priority to U.S. Application Ser. No. 63/472,115 filed on Jun. 9, 2023, the contents of which are herein fully incorporated by reference in its entireties.

FIELD OF THE EMBODIMENTS

The field of the embodiments of the present invention relate to storefront shelf having a front transparent barrier that permits extraction of a single shelf contained product, and more specifically, to a pass-through loss prevention system for brick-and-mortar storefront shelving.

BACKGROUND OF THE EMBODIMENTS

Many categories of retail products, due to relatively high sales prices and consumer desirability, are more likely to be stolen and as a result locked-up. For example, flash drives, some cold medications, fragrances, family planning items, electronic devices, and tools are commonly secured in a manner inhibiting consumers from directly accessing such items from a shelf and placing them in a cart prior to checkout. Often, the utilized security mechanisms require retail agent assistance prior to a consumer being able to handle such items. While such mechanisms reduce levels of theft as intended, they also diminish a retail experience for many shoppers taking the fun out of the experience. Reduced enjoyment during a shopping experience at a brick-and-mortar store can result in decreased traffic and sales, especially as many consumers gravitate towards online storefronts for purchases.

Retailers and their employees remain frustrated at the current situation as even time-honored techniques like locked tempered glass systems are not only expensive as theft has increased in especially urban stores so more security door systems are needed, but also because thieves have become more brazen breaking thru tempered glass solutions and utilizing techniques such as flash robs. And, as thieves have become more brazen stealing from increasing categories of goods, some retailers have turned to putting many more categories behind locked cases. Locked shelf systems today entail the retail employee coming to a certain area of the store to open a locked case (plastic or glass) to allow the shopper to take what she or he may want. As noted above, this is expensive and time-consuming for the retailer and very inconvenient for the honest shopper.

According to the NRF, more than $100 billion worth of goods are stolen from retailers each year. Moreover, 1 in 11 people will commit the crime of shoplifting at some point in their lives, but only 10 million people have been caught shoplifting in the last five years. Plus, retailers report a large increase in organized retail crime over the last few years. When a company is as big as WALMART, for example, everything is huge, even losses from shoplifting. The retailing giant says that it loses about $4-5 billion every year from theft, or 1% of its $500+ billion in revenue (REUTERS).

What is needed is a shelf-based theft deterrent system that permits a better, low-cost frictionless shopping experience, while minimizing product theft especially that characterized by large volume, rapid thefts involving shelf sweeping and similar techniques.

SUMMARY OF THE EMBODIMENTS

Embodiments of the disclosure detail a storefront theft prevention system that has been referred to as a pass-through shelf, pass-through loss prevention system, and/or pass-through security door system. In the system, a front, transparent barrier is used, which has at least one exit opening for extracting shelved products. The disclosed loss minimization technique prevents rapid, large scale thefts where one or more shoplifters rush a store, rapidly clear merchandise off shelves, and run out with the unpaid merchandise. For example, organized theft rings (OTR) have been known to utilize a flash rob tactic, where a group rushes into a retail establishment and rapidly departs with as much merchandise as possible. Flash rob style thefts often involve significant quantities of moderately valued goods.

Brick-and-mortar retailers are already suffering intense competition from online counterparts, who are able to competitively price goods due in part to minimal storefront and employee overhead. Flash rob techniques are particularly challenging to retailers, which are often frequented by customers desiring an in-person retail shopping experience. A satisfactory shopping experience requires a level of consumer autonomy and convenience, which is impeded when products-to-be-purchased are locked or otherwise made inaccessible without sales agent assistance.

One aspect of the disclosure is directed to a brick-and-mortar storefront shelf for self-serve, single product extraction that minimizes store losses from rapid shelf clearing thefts, such as shown in FIGS. 2A, 2B, and 2C. The shelf is configured to make manual extraction of a single product from the shelf easy, while making extraction of multiple shelf items somewhat time consuming. The shelf includes an interior volume, referred to as a shelf storage volume, within which shelf contained products are kept. The shelf storage volume can be a three dimensional rectangle constrained by a shelf top, a shelf bottom, two sidewalls, a shelf back, and a shelf front. The shelf front can be an approximately planar surface able to be opened and closed. Approximately planar means the front may be flat, somewhat curved, and/or can be generally flat with a few concave/convex subsections. Effectively, the store front can be transparent barricade, which is realized as a set of door(s) or panel(s) able to be opened/closed and locked.

The store shelf front includes at least one product exit aperture, a set of product movement apertures, and a transparent barrier. The product exit aperture is an opening/hole through which products are removed from the shelf storage volume to the outside environment. The product movement aperture is a set of openings/holes through which a user can insert their hands/arms to manually move shelf contained products from an initial position the product exit aperture. More specifically, each product exit aperture s an exit void having an area sufficiently large to permit the shelf contained products to be individually moved from the shelf storage volume to an outside environment. At the same time, the product exit aperture is a bottleneck sufficiently small to inhibit multiple shelf contained products from exiting at once. That is, the exit void has an area sufficiently small so that two shelves containing products are unable to concurrently fit through it, wherein when the shelf front is closed. The product exit aperture(s) is the only opening sufficiently large to permit any of the shelf contained products to be individually moved from the shelf storage volume to the outside environment. The product movement apertures are each an aperture void having an area sufficiently large to permit a hand/arm of a shopper to pass from outside the shelf storage volume into the shelf storage volume. With the shopper's hand extended in the shelf volume, the shopper can positionally move shelf contained products from one location/position to another within the shelf storage volume. This can be done repetitively, using different apertures to effectively permit a full range of movement of the shelf contained product from an initial position to the exit. So, in aggregate, the product movement apertures are configured to permit movements of all of the shelf contained products from an arbitrary initial position within the shelf storage volume to a position immediately proximate to the product exit aperture. The shelf contained product can be extracted to the outside environment through the product exit aperture by movements of the shopper's hand as it extends into the shelf storage volume via the product movement aperture(s). The transparent barrier permits the shopper to see the shelf contained products. The product exit aperture(s) and the product movement aperture(s) are voids or openings in the transparent barrier.

Another aspect of the disclosure is directed to a storefront shelf having a shelf front, a shelf top, a shelf bottom, a right sidewall, and a left sidewall. The shelf front can be a substantially planar surface, where substantially planar permits deviations of up to ten percent from flat. The shelf front includes a transparent barrier, one or more product exit apertures, one or more product movement apertures, and a set of restocking components, The transparent barrier permits shoppers to view shelf contained products and, when closed, inhibit extraction of any of a set of shelf contained products except through at least one product exit aperture of the shelf front. Each product exit aperture is an opening in the shelf front sufficiently large to permit one of the shelf contained products to pass. The product movement apertures are each openings in the shelf front sufficiently large to permit a hand of the shopper to pass and to thereafter manipulate positions of the shelf contained product. The set of restocking components are connected to open and close the transparent barrier. When the transparent barrier is open the shelf contained products can be restocked via the opening.

Embodiments of the present invention relate to a locked Pass-Through Security Door System for retail stores providing for shoppers to have the ability to take a single product at a time from the locked case from Pass-Through holes or slits without store associate help. Embodiment can be applied to a single shelf, a multi-shelf cabinet or assembly, or to an entire category of products. The shopper via a series of holes or slits in the clear plastic, tempered glass, or other transparent material, which is in front of the product protecting it from theft, reaches into the hole or slit to move the desired product through the hole (or oval, or any geometrically created cut-out) directly or down an exit well rail to then exit through the exit well opening on either end, allowing the shopper to take the product with no help from the store associate. Currently all locked cases at retail entail either a store associate to unlock the case for the shopper to take product or there are also some newer E-Commerce locked-case approaches that enable the shopper with a QR code, phone, or store card to get an electronic acknowledgment thus opening a locked case. But such E-Commerce concepts can get very expensive, and obviously to have a store associate open a locked case is time-consuming for the shopper and retailer, costly for the retailer, and frustrating for the shopper. The disclosed system, which can be referred to as the TRINITY system, is a low-cost innovation that will deliver "frictionless" shopping to the consumer and the retailer. This new locked case system can be made of unbreakable clear polycarbonate plastic in the front supported by a metal or plastic frame. With the use of polycarbonate that is virtually unbreakable—hockey rink "glass"—TRINITY will be helping to circumvent another of today's current challenges with retail theft . . . thieves literally breaking tempered glass doors or shelf barriers to steal product.

Embodiments of the present invention translate to a new innovative low-cost plastic polycarbonate security case system with strategically placed "pass-through" openings (could be holes, ovals, slits) in the clear plastic, allowing the shopper to put her/his hands in to take the product directly through the opening or move product down to an Exit Well at the front of the shelf to an Opening Well (can be in the middle or ends of the case) and out from behind the locked case thus allowing the shopper to take the product to the check-out for purchase. This is "single-product-only-shopping." The openings are small enough to disallow any shopper from just pulling multiple products out in a sweeping motion. The later approach to stealing at retail is called "sweep" and results in lots of theft at retail given it can be done so quickly by a thief. Opposed to other locked cases, again this new, novel approach does not require the shopper to get assistance from a store associate.

As noted, the front of the case may be a clear highly-durable polycarbonate plastic allowing for great visibility of product for the shopper to make his/her product choice. The polycarbonate front is integrated into a steel or plastic frame that in turn is attached to the store shelves above and below where the product sits. The frame itself is attached to the shelf in a meaningful way, and because the attachment mechanism of the frame is behind the polycarbonate front, the attachment mechanism is not accessible by anyone other than the store associates. Metal sides can be added to the case as needed, especially on the side that is at an end. Steel glides are attached to the doors and the steel top and bottom frames. The steel glides also serve as spacers that allow the doors to pass by each other in a smooth fashion. Finally, a lock is integrated into the frame bottom in embodiments.

The clear front, otherwise referred to as a transparent barrier, with the pass-through opening, also referred to as product exit apertures and product movement apertures, can also be affixed to a frame system that allows multiple pass-through fronts to be installed to multiple shelves vertically and or horizontally. For example, the disclosed shelf can be added to a universal shelving system having slotted beams that secure brackets supporting the base of substantially horizontal shelf surfaces. The clear front can attach to the front of a shelf any number of ways to protect product merchandise. In a scenario of shelved product, simple brackets can attach the frame to the existing gondola base deck and top shelf, making for easy installation. Unique brackets can be designed to attach the door assembly to other gondola types.

DESCRIPTION OF THE PREFERRED EMBODIMENTS

Figure 1A:
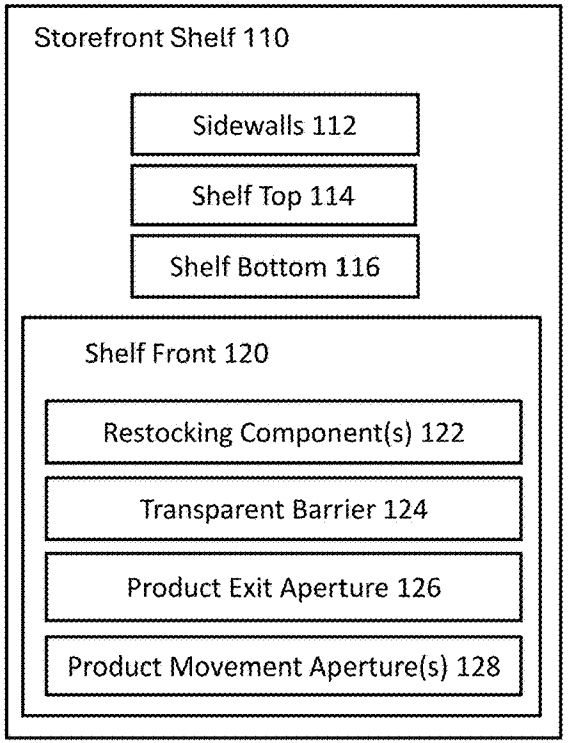
FIG. 1A shows a storefront shelf, according to at least some embodiments disclosed herein.

The preferred embodiments of the present invention will now be described with reference to the drawings. Identical elements in the various figures are identified with the same reference numerals.

Reference will now be made in detail to each embodiment of the present invention. Such embodiments are provided by way of explanation of the present invention, which is not intended to be limited thereto. In fact, those of ordinary skill in the art may appreciate upon reading the present specification and viewing the present drawings that various modifications and variations can be made thereto.

As used herein, the singular forms "a," "an," and "the," are intended to include the plural forms as well, unless the context clearly indicates otherwise.

As used herein in the specification and in the claims, the phrase "at least one," in reference to a list of one or more elements, should be understood to mean at least one element selected from any one or more of the elements in the list of elements, but not necessarily including at least one of each and every element specifically listed within the list of elements and not excluding any combinations of elements in the list of elements. This definition also allows that elements may optionally be present other than the elements specifically identified within the list of elements to which the phrase "at least one" refers, whether related or unrelated to those elements specifically identified. Thus, as a non-limiting example, "at least one of A and B" (or, equivalently, "at least one of A or B," or, equivalently "at least one of A and/or B") can refer, in one embodiment, to at least one, optionally including more than one, A, with no B present (and optionally including elements other than B); in another embodiment, to at least one, optionally including more than one, B, with no A present (and optionally including elements other than A); in yet another embodiment, to at least one, optionally including more than one, A, and at least one, optionally including more than one, B (and optionally including other elements); etc.

As used herein, an "embodiment" means that a particular feature, structure or characteristic is included in at least one or more manifestations, examples, or implementations of this invention. Furthermore, the particular features, structures or characteristics may be combined in any suitable manner, as would be apparent to a person skilled in the art Combinations of features of different embodiments are all meant to be within the scope of the invention, without the need for explicitly describing every possible permutation by example. Thus, any of the claimed embodiments can be used in any combination.

The phrase "and/or," as used herein in the specification and in the claims, should be understood to mean "either or both" of the elements so conjoined, e.g., elements that are conjunctively present in some cases and disjunctively present in other cases. Thus, as a non-limiting example, a reference to "A and/or B", when used in conjunction with open-ended language such as "comprising" can refer, in one embodiment, to A only (optionally including elements other than B); in another embodiment, to B only (optionally including elements other than A); in yet another embodiment, to both A and B (optionally including other elements); etc.

Figure 2A:
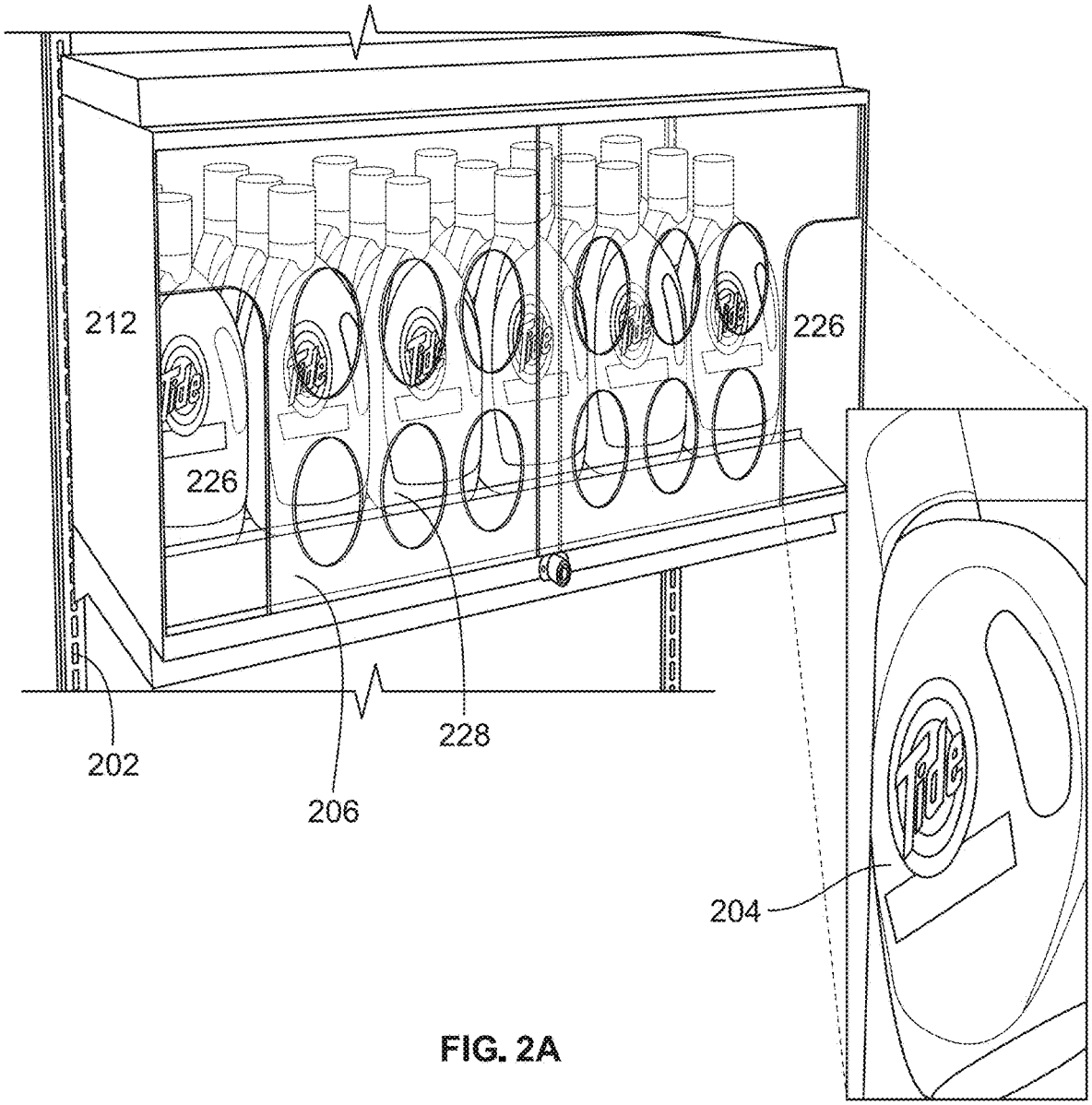
FIG. 2A shows a storefront shelf having two rows of movement apertures and two exit apertures, according to at least some embodiments disclosed herein.

FIG. 1A shows a novel storefront shelf, which includes a semi-blocked shelf front 120. The semi-blocking of shelved products allows shoppers to select and remove individual products of their choice from a shelf 110 without assistance, while at the same time preventing rapid de-shelving of large quantities of products. As seen in FIG. 2A, for example, a shelf is stocked with branded laundry detergent 204, which can be removed on an item-by-item basis from a shelf via an opening 226, which is referred to in FIG. 1A as a product exit aperture 126 (or product exit). The product exit aperture 126 is dimensioned to permit a product to be extracted from shelf 110. In embodiments, only one product can fit through the opening (126) at a time. Products on a shelf can be moved to the exit aperture 126 by hand, which can require a shopper to extend their hand through one or more product movement apertures 128 or openings. For example and as noted in FIG. 2B, a shopper can reach through product movement aperture 228 to grab a product and slide/shove/move it so that it is able to pass through opening (226). The product movement apertures 128 may be large to permit a hand/arm to pass, while sufficiently small to not permit a shelved product to pass. For example and with reference to FIG. 2A, the detergent product 204 is able to fit through opening 226, but cannot fit through opening 228.

Use of a shelf front 120 having a transparent barrier 124 and a set of apertures 126, 128 prevents a large quantity of products from being rapidly removed from shelving via a single sweeping motion. At the same time, a shopper can rapidly receive a single shelved unit without any employee assistance. Further, a shopper can see the products contained within the contained volumetric region of the shelf 110. Thus, the shelf front 120 detailed herein prevents or minimizes theft, without significantly inconveniencing honest shoppers and without expenses related to increased employees.

Figure 1B:
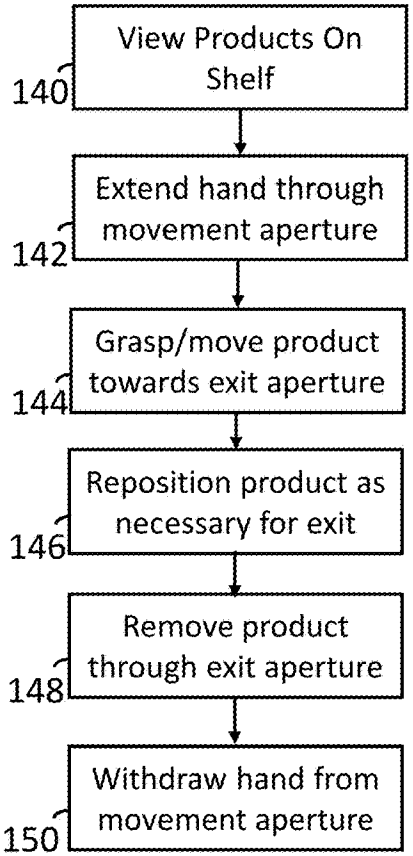
FIG. 1B shows a process for obtaining a single product from the storefront shelf of FIG. 1A, according to at least some embodiments disclosed herein.
Figure 2B:
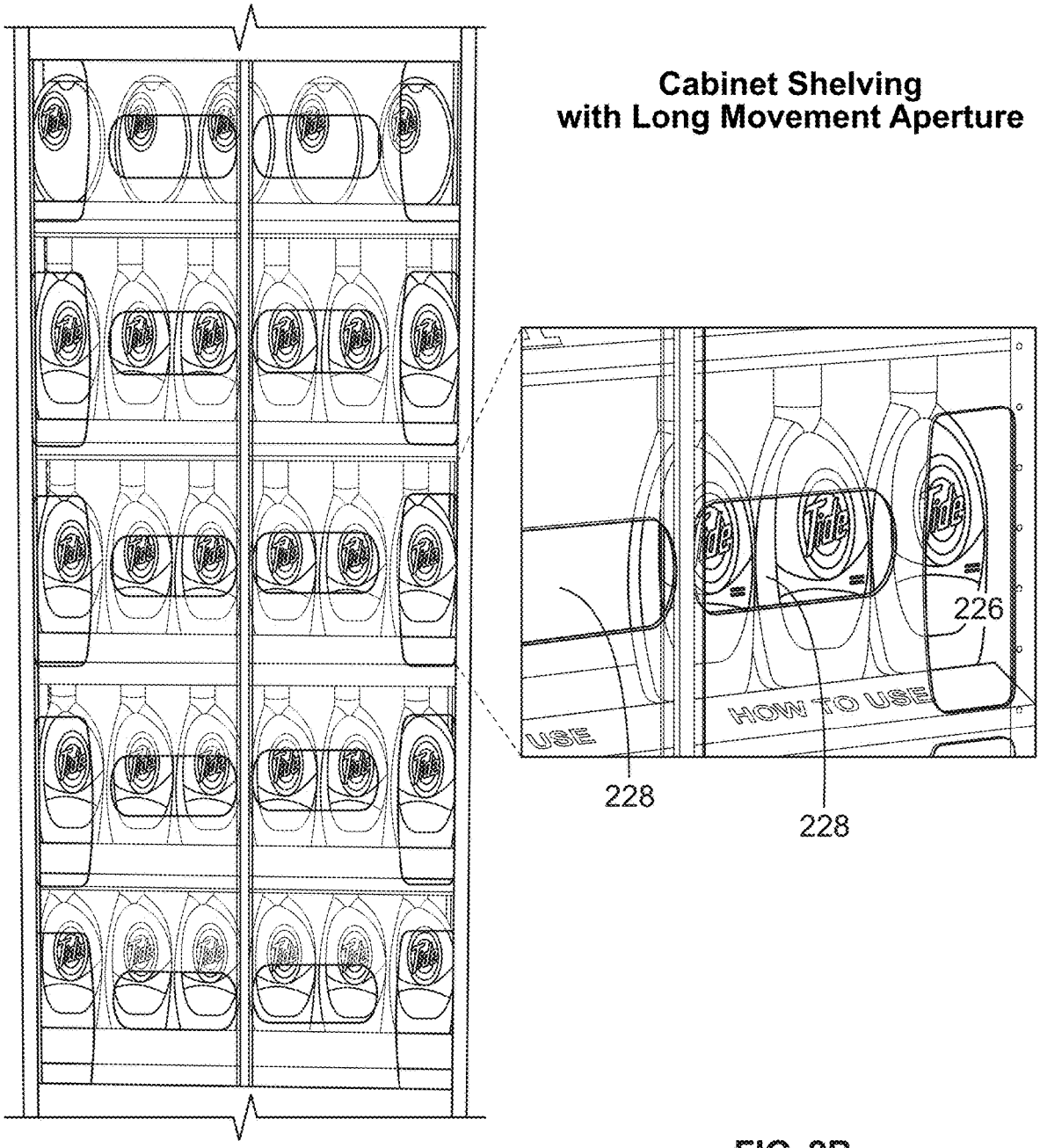
FIG. 2B shows a storefront cabinet with five shelves, according to at least some embodiments disclosed herein.
Figure 2C:
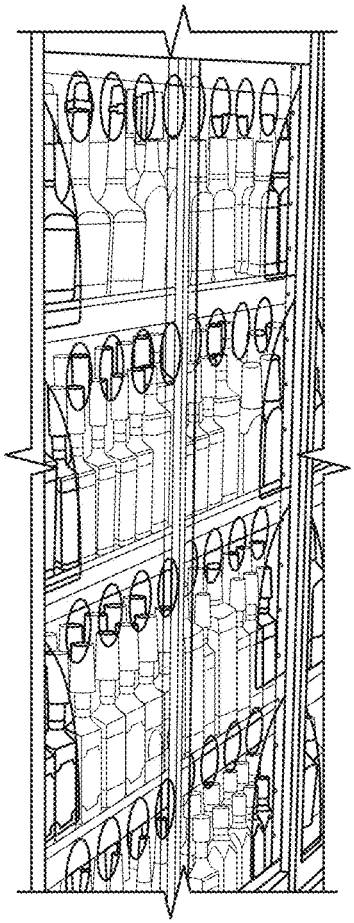
FIG. 2C shows a storefront cabinet for alcoholic beverage products, according to at least some embodiments disclosed herein.

With reference to FIG. 1B, products are placed on a shelf behind a transparent barrier 124, which permits shelved products to be viewed, as noted by step 140. In step 142, the hand of a shopper can be extended through one or more product movement apertures 128. In step 144, the shopper can grasp, slide, or otherwise move the product towards the exit aperture 126 via the hand that extends through aperture 128. In step 146, a product can be rotated, tilted, or repositioned as necessary to facilitate removing the product via exit aperture 126. For example, as illustrated in FIG. 2H, a slide rail or front portion of the shelf behind the transparent barrier 124 may exist to reposition the product prior to extracting it through an exit opening (126). In step 148, the product can be removed through exit aperture 126. In step 150, a hand can be withdrawn from movement aperture 128.

With regard to step 150, in a preferred embodiment, a portion of barrier 124 separates different apertures 126, 128 from each other. Thus, a shopper cannot slide his/her hand from movement aperture 128 to exit aperture 126, as such a motion could permit the shopper to clear many shelved products via a single sweeping motion, which is inhibited. In embodiments, a product positioned an appreciable distance from exit 126 may require a hand to pass through more than one movement aperture 128. In embodiments, a single shelf may have multiple exit apertures 128, such as having a right exit and a left exit, as shown by the shelves in FIG. 2A. A central exit aperture can exist in embodiments (not illustrated).

In other embodiments, different internal shelf barriers can be positioned to inhibit sliding of a product across the internal barrier. With reference to the cabinet shown on the left of FIG. 2B, a shelf can be sufficiently wide to space six detergent products across. An internal barrier can be placed near the shelf's middle, so that the left most three detergent products per shelf must be removed via a left-most exit aperture 128, and the rightmost three products be removed from a right exit 126. Internal barriers are not present in all embodiments, but may be useful in others, such as when different sized apertures for different products on a single shelf exit, which is shown by FIG. 2F.

Figure 1C:
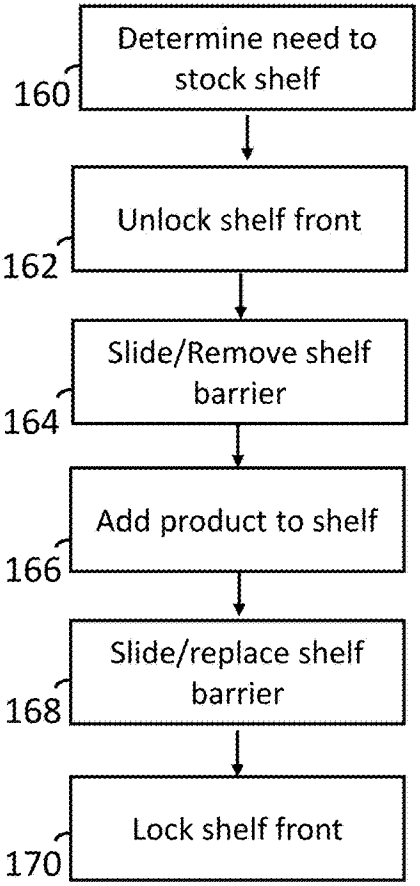
FIG. 1C shows a process for restocking the storefront shelf of FIG. 1A, according to at least some embodiments disclosed herein.

The disclosure enables rapid restocking of shelved items, as elaborated upon by FIG. 1C. In step 160, a need to stock a shelf can be determined, such as by looking through transparent barrier 124 and noticing a shelf being relatively empty. In embodiments, the shelf 110, shelf front 120 or portions thereof can be selectively locked/unlocked.

Figure 2D:
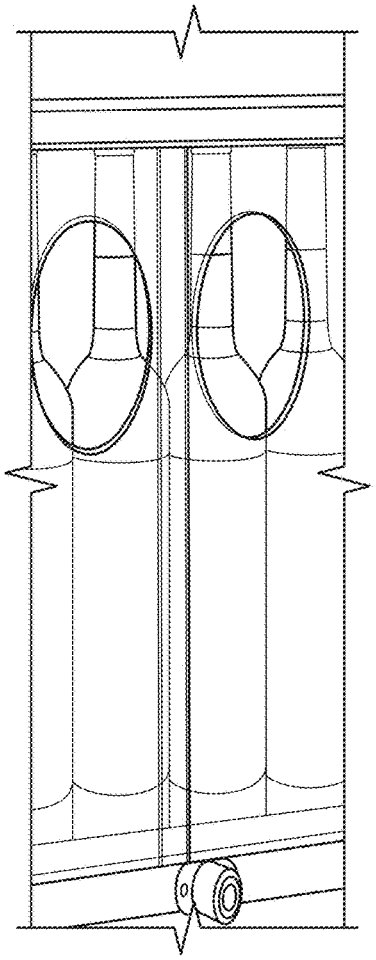
FIG. 2D shows a storefront shelf having sliding front panes and a lock, according to at least some embodiments disclosed herein.

As shown in FIG. 2D, for example, a set of locking doors or transparent panes can exist. In one embodiment, these doors slide so that two doors (see FIG. 2A) can be slid to the right to place product onto the leftmost shelf region, then slid to the left to place product onto the rightmost shelf region (see FIG. 2J). In another embodiment, the shelf front 120 can be hinged to open/close. For instance, a split shelf front can be hinged on both the right and left side to open in a manner like a kitchen cabinet. In another embodiment, the shelf front 120 can use a top hinge, to open upwardly. A latch or other temporary securing mechanism may prevent an open and hinged portion of front 120 from moving until the latch is released. In still another embodiment, the shelf front can be removed during restocking to be replaced when restocking has completed. The various hinges, latches, slides, removing mechanisms, etc. that enable selective removal of obstructions during restocking operations are generically referred to in aggregate as restocking components 122. The method depicted in FIG. 1C assumes restocking components 122 include a slidable/lockable front segment, such as shown by FIGS. 2A, 2C, and 2D.

In step 164, a front pane can be slid (or otherwise removed) allowing for unimpeded restocking access. In step 166, a product is added to the shelf. In step 168, the removed, slid, hinged portions of the shelf front are replaced 168. In step 170, the shelf front is locked. When the shelf front is in place and locked, removal of shelved product must occur through the product exit aperture 126. Thus in embodiments, aperture 126 is the only opening to the shelf volumetric space through which products can be removed; at least when the shelf front 120 is in a closed position.

FIG. 2A shows a single shelf embodiment of the loss prevention device for shelving. This shelf is considered a pass through system. As shown, two slidable front doors or panes of transparent material are shown. High-impact, virtual industrial materials, such as a polycarbonate plastic, can be utilized for the doors. In one embodiment, the exit well (or floor of the shelf) 206 can provide a marketing space for brand communication. In another embodiment, exit well 206 can include an extruding ledge able to support (at least temporarily) a product being extracted from the shelf (see also FIG. 2J). In another embodiment, a lower support structure (not shown) can extend outward from (or slightly below) the exit opening(s) 226, which allows for a brief resting of the product being extracted prior to a fall resulting from gravity. In embodiments, where products 204 are not especially heavy, a need for additional support/ledges is minimal and such enhancements are unnecessary. As shown, a railing or frame secures the slidable doors/panes in place. The shelf, as shown, includes a lock.

The inclusion of the shelf front 120 can be a standardized adaptation for standardized shelving units in embodiments. That is, industrial standards exist for slotted and adjustable shelving units. A wall (or device mounted) bracket used in a shelving system may, for example, have a series of slots (202) designed for positioning and supporting a set of slotted brackets, which support a horizontally extending shelf bottom 116. Standards include, but are not limited to, medium weight (1/16") or heavy weight (3/32") universal slotted standards with ½" slots on 1" centers. As a standards compliant shelving unit, a single shelf or tier of a multi-tiered shelving unit may include the barrier 124 (See FIG. 2J), while other tiers do not. In one contemplated embodiment, relatively high, upper shelves may be configured without barrier 124, while middle or lower shelves will include it. It may be relatively easier to reach through apertures 126, 128 of middle positioned shelves, compared to higher or lower ones. Further, a vast majority of "problematic" shelving may be restricted to the most readily accessible height(s) or tiers of shelves. In other embodiments, an entire unit of shelves, such as the five tiered shelving unit of FIG. 2B, may include the shelf front 120.

Figure 2E:
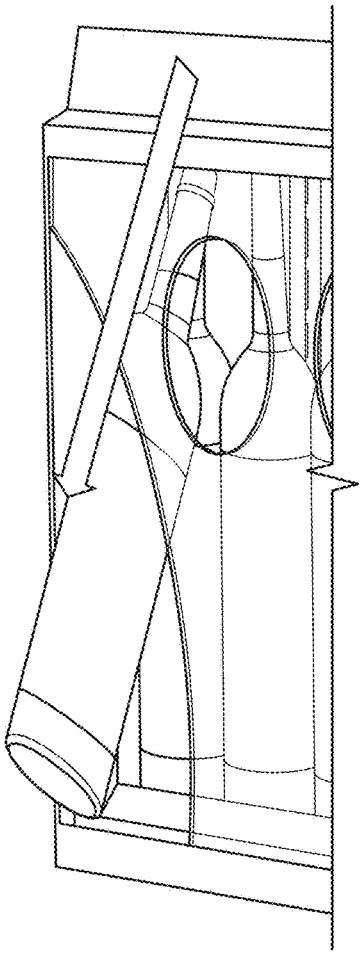
FIG. 2E shows a storefront cabinet with an exit aperture for wine bottles, according to at least some embodiments disclosed herein.
Figure 2F:
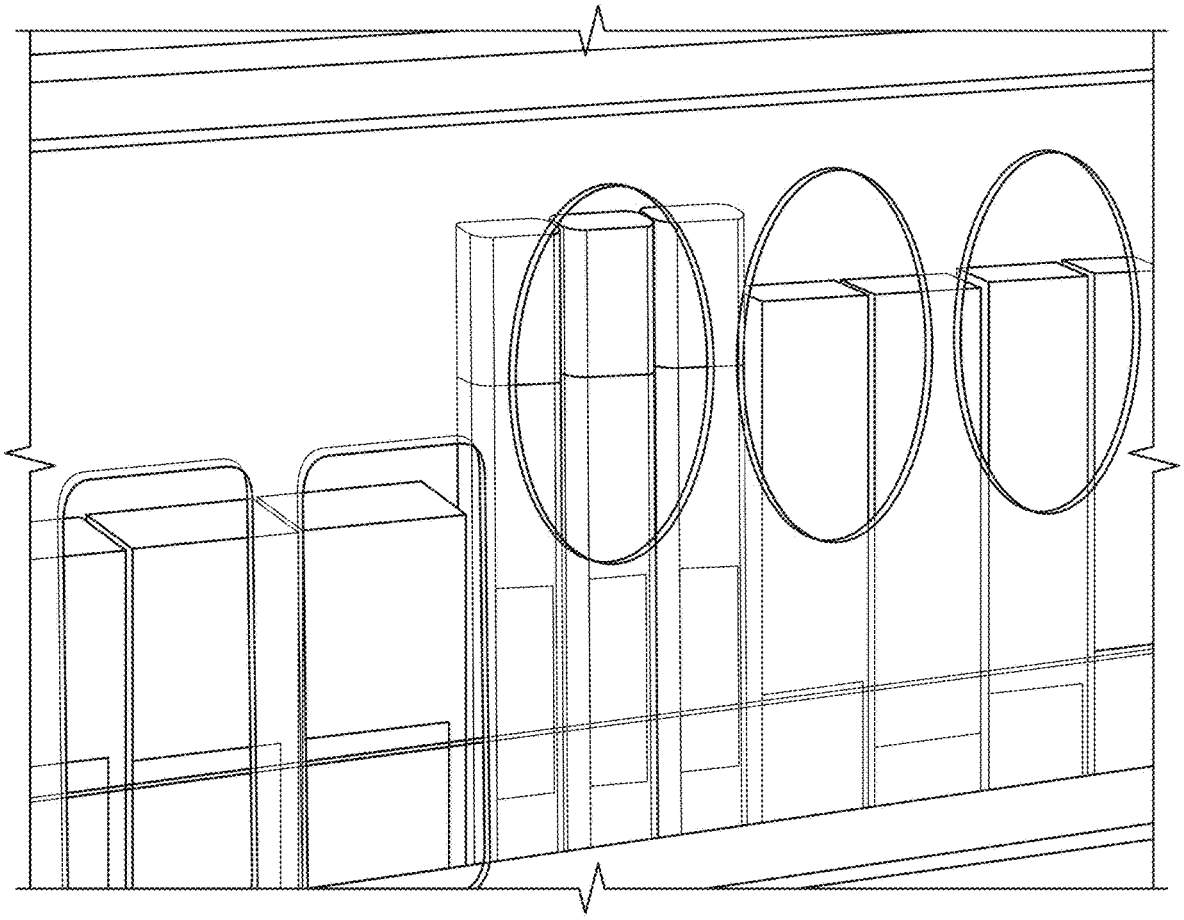
FIG. 2F shows a storefront shelf with variable sized product exit apertures sized for shelved products, according to at least some embodiments disclosed herein.
Figure 2G:
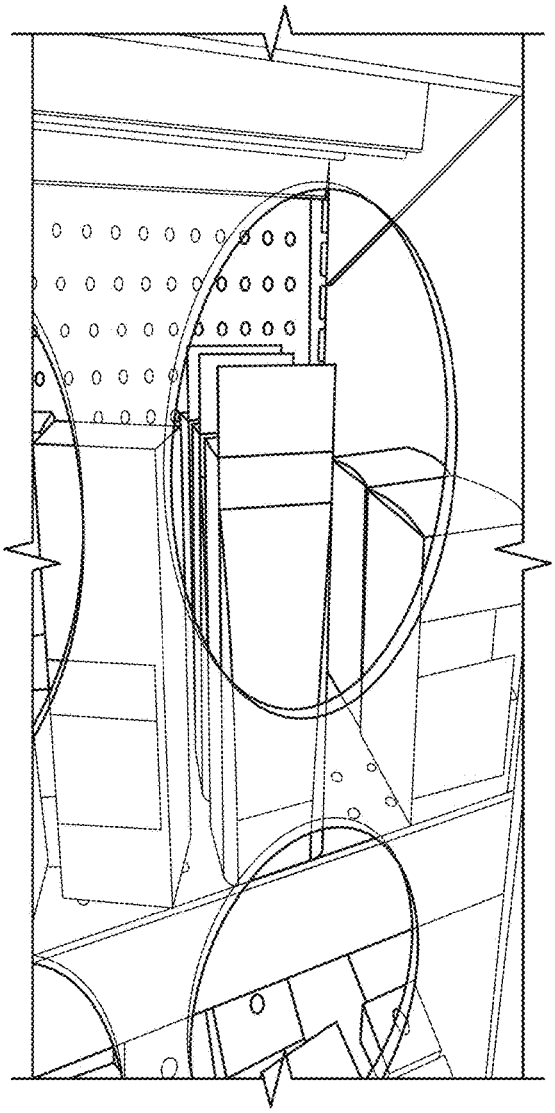
FIG. 2G shows a storefront shelf with apertures, each serving as both a product movement aperture and a product exit aperture, according to at least some embodiments disclosed herein.
Figure 2H:
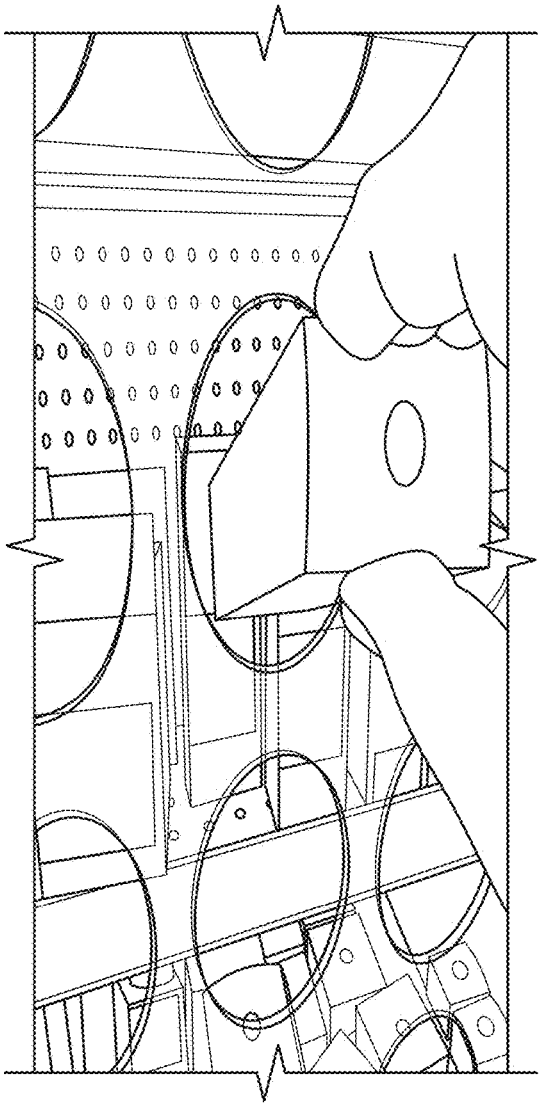
FIG. 2H shows use of the aperture of FIG. 2G, according to at least some embodiments disclosed herein.
Figure 2J:
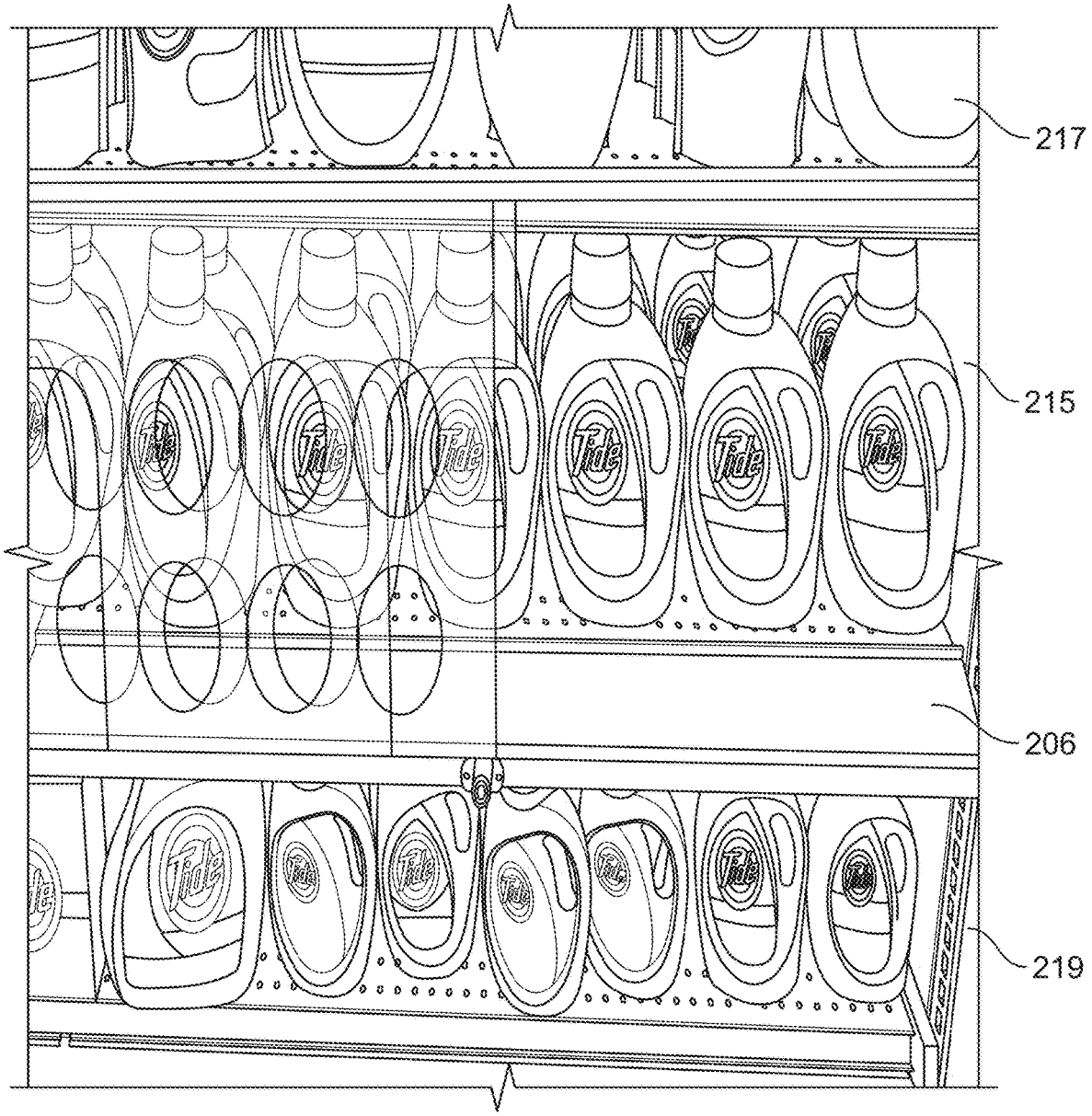
FIG. 2J shows a storefront cabinet with two conventional shelves and a middle pass-through protected shelf, according to at least some embodiments disclosed herein.

FIG. 2J visually illustrates a middle shelf 215 having a shelf front 120, which a shelf 217 immediately above and immediately below 219 lack. Like FIG. 2A, the shelf 215 includes an extending/extruding exit well 206, which extends outwardly towards the aisle (more than shelf 217 or 219. As shown in FIG. 2J, slidable panes or doors are unlocked and slid to the left, to permit a restocking of product on the right side of the shelf 215.

Whether being implemented in a standardized shelving embodiment or not, the sides of the shelf can be enclosed with sidewalls 112, 212 to prevent product from being removed from the shelf side. In a preferred embodiment, each exit 126, 226 is positioned in the front and is a void in the shelf front 120 through which a shelved product can pass. In an alternative embodiment, the product exit aperture 126, 226 can be positioned in a void within the sidewall 112, 212 of the shelves.

In embodiments, a shelf top 114 of one shelf can be realized by a shelf bottom 116 of a shelf immediately above it. Thus, the top 114 of the second shelf can be the bottom of a third shelf. In embodiment where a shelf boundary functions as both a bottom and a top of a tiered shelving system, it may include appropriate railings for sliding elements of each tier. For example, a front 120 of a shelf of FIG. 2A includes two slidable, transparent planes of material, and the tops and bottoms include railings allowing the planes to slide.

Different sizes, shapes, and positions of movement apertures 228 are contemplated. In general, the movement apertures 228 permit shoppers to easily reach through yet have a smaller diameter/perimeter than that of the product. In FIG. 2A, product 204 (container of detergent) fits through exits 226, but not through movement aperture 228. Apertures 228 are circular and relatively evenly spaced in two parallel, horizontal lines. In FIG. 2B, oval movement apertures 228 are used, which are spaced horizontally, one centrally positioned in each pane (or slidable door). The oval arrangement 228 permits rapid movement of product towards exist 228 without needing to insert/extract a hand multiple times through different apertures 228.

Figure 2K:
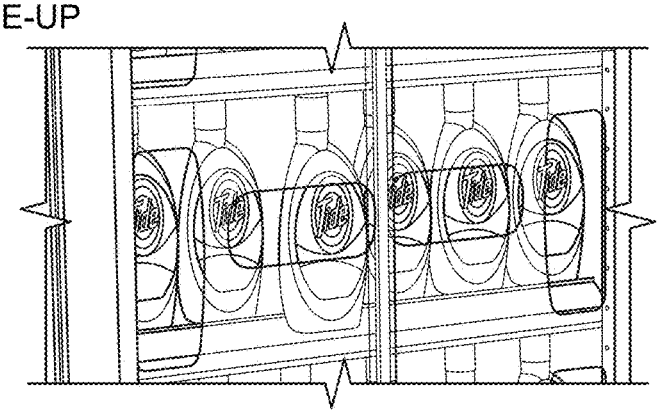
FIG. 2K shows a detergent pass-through system and basic shopper directed instructions for its use, according to at least some embodiments disclosed herein.
Figure 2K:
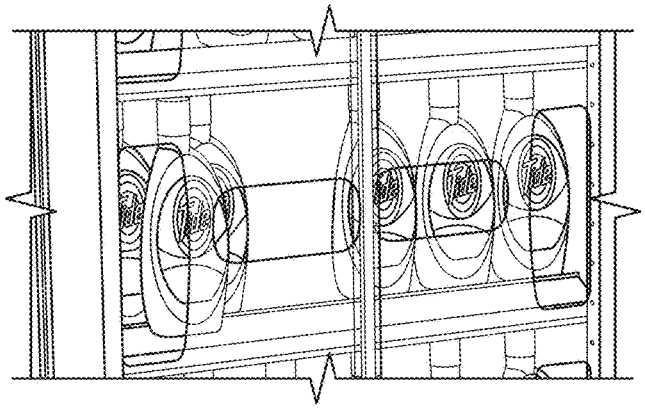
Figure 2K:
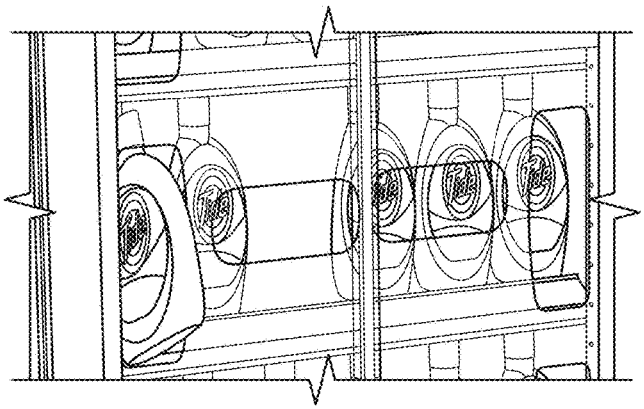

FIG. 2K illustrates use of a shelf with oval movement apertures 226. As shown, in a first step a shopper reaches through the oval cut out (128, 228) and brings the product onto the front rail guide (206). In a second step, the detergent product is slid to the exit well on either side. In the third step, the product is angled and removed from the exit opening (216).

Use of a long oval aperture 218 can be appropriate for shelved products unable to be "shoved" through an exit easily. That is, an alternative to a body swipe to clear a shelf rapidly is to be avoided. In one embodiment, a ridge or series of ridges, requiring a product to be lifted upward prior to being extracted from exist 226, can be used in conjunction with a long oval movement aperture 216 to maximize user convenience while minimizing rapid product de-shelfing capabilities, which may lead to loss.

Figure 2L:
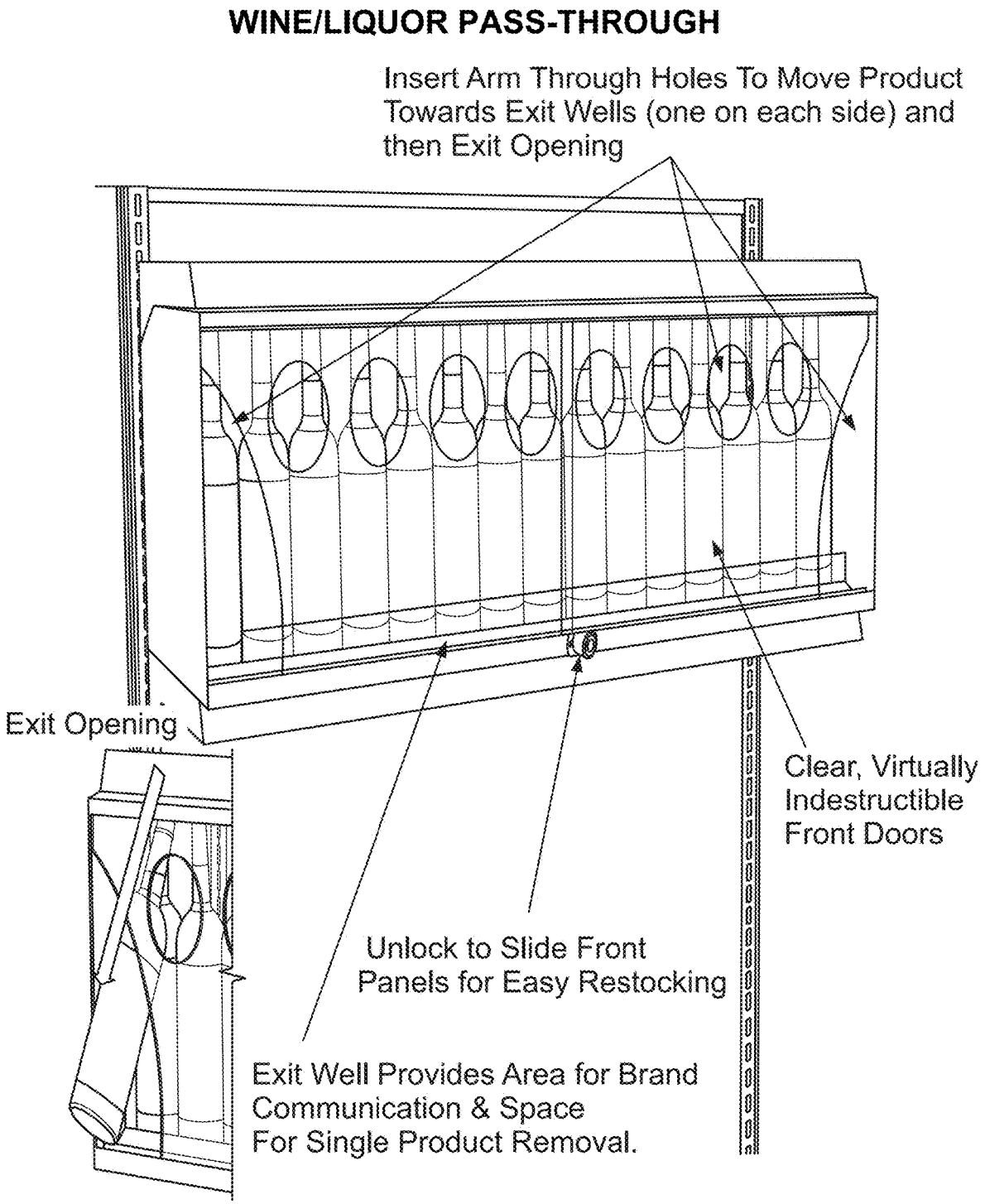
FIG. 2L shows a wine/liquor pass-through system and basic shopper directed instructions for its use, according to at least some embodiments disclosed herein.

FIG. 2C shows inclusion of a set of upper apertured 128, which may be positioned to minimize attempt to "yank/tilt bottles through the movement aperture 128; as opposed to through the designed exit 126, which is shown by FIG. 2E. Placement and size of the apertures 118 can minimize improper shoppers use/attempts, as can instructional signs, graphics, and warnings present in embodiments. For example, an image showing a person attempting to yank a bottle through a movement aperture 118 with an "X" through it can be presented in embodiments to discourage improper use. In another embodiment, an encouraging proper image similar to what is shown in FIG. 2E can be presented as a visual instruction. For example, FIGS. 2K and 2L represent instructional materials able to be posted next to pass-through shelving units in embodiments.

As demonstrated by FIGS. 2A, 2B, 2C, 3D, and 2E, preferably products will not fit through movement apertures 126, but only through the larger exits 128. In some embodiments, however, movement apertures 128 are exits 126, as shown by FIGS. 2G and 2H. That is, a single opening is used to reach through, grab a product, and extract both the product and the hand from the interior shelf space referred to as the shelf storage volume. FIG. 2F shows variably sized openings (126, 128) that function as both exit and movement apertures. For example, the product on the left is shown with square openings (126, 128) positioned lower than the round openings (126, 128) shown on the right.

The block diagrams in the Figures illustrate the architecture, functionality, and operation of possible implementations of computer systems, methods, and computing devices according to various embodiments of the present invention. In this regard, each block in the block diagrams may represent a module, a segment, or a portion of executable instructions for implementing the specified logical function (s). In some alternative implementations, the functions noted in the blocks may occur out of the order noted in the Figures. For example, two blocks shown in succession may, in fact, be executed substantially concurrently, or the blocks may sometimes be executed in the reverse order, depending upon the functionality involved.

The descriptions of the various embodiments of the present invention have been presented for purposes of illustration but are not intended to be exhaustive or limited to the embodiments disclosed. Many modifications and variations will be apparent to those of ordinary skill in the art without departing from the scope and spirit of the described embodiments. The terminology used herein was chosen to best explain the principles of the embodiments, the practical application or technical improvement over technologies found in the marketplace, or to enable others or ordinary skill in the art to understand the embodiments disclosed herein.

Although this invention has been described with a certain degree of particularity, it is to be understood that the present disclosure has been made only by way of illustration and that numerous changes in the details of construction and arrangement of parts may be resorted to without departing from the spirit and the scope of the invention.

What is claimed is:

1. A brick and mortar storefront shelf for self-serve, single product extraction that minimizes store losses from rapid shelf clearing thefts, said shelf comprising:

a shelf storage volume within which shelf contained products are contained, said shelf storage volume being constrained by a shelf top, a shelf bottom, two sidewalls, a shelf back, and a shelf front, said shelf front being an approximately planar surface configured to be opened and closed, said shelf front comprising:

a continuous length of material having at least one product exit aperture, which is an exit void having an area configured to permit one or more products to be individually removed from the shelf storage volume to an outside environment, wherein when the shelf front is closed, the at least one product exit aperture is the only opening configured to permit the one or more products to be individually moved from the shelf storage volume to the outside environment;

a plurality of product movement apertures, each of which is an aperture void configured to permit a hand of a shopper to pass from outside the shelf storage volume into the shelf storage volume and to positionally move contained products within the shelf storage volume, wherein in aggregate the product movement apertures are configured to permit movements of all of the shelf contained products from an arbitrary initial position within the shelf storage volume to a position immediately proximate to the product exit aperture such that the shelf contained product is able to be extracted to the outside environment through the product exit aperture by movements of the shopper's hand extending into the shelf storage volume via one of the product movement apertures, and wherein the plurality of product movement apertures are smaller than the at least one product exit aperture; and a transparent barrier permitting the shopper to see the shelf contained products, wherein the product exit aperture and the plurality of product movement apertures are voids in the transparent barrier.

2. The storefront shelf of claim 1, a set of restocking components connected to open and close the transparent barrier, wherein when the transparent barrier is open the shelf contained products are able to be restocked via the opening.

3. The storefront shelf of claim 1, further comprising:

an exit well, which is a horizontal ledge extending along at least eighty percent of the horizontal length of the shelf, which is positioned in a front portion of shelf bottom.

4. The storefront shelf of claim 1, wherein the storefront shelf is configured for inclusion in a shelving system having slotted beams that secure brackets supporting a base of substantially horizontal shelf surfaces, wherein other shelves of the shelving system lack the transparent barrier.

5. The storefront shelf of claim 1, further comprising:

a lock to lock the shelf front when closed.

6. The storefront shelf of claim 1, wherein the transparent barrier is a polycarbonate plastic.

7. The storefront shelf of claim 1, wherein each of the product exit apertures are circles, evenly spaced from one another in a horizontal line along the transparent barrier.

8. The storefront shelf of claim 1, wherein the storefront shelf comprises two product exit apertures, which consist of a right side exit aperture and a left side exit aperture.

9. The storefront shelf of claim 1, wherein the transparent barrier comprises two panes, each of which are configured to open by sliding along rails of the storefront shelf, wherein the storefront shelf further comprises a locking mechanism for positionally locking the two panes when closed.

10. A storefront shelf comprising:

a front portion which is substantially planar comprising:

a continuous transparent barrier configured to permit shoppers to view shelf contained products and further configured to inhibit extraction of any of a set of shelf contained products except through at least one product exit aperture of the front portion;

the at least one product exit aperture, which is an opening in the front portion configured to permit one of the shelf contained products to pass; and a plurality of one product movement apertures, each being an opening in the front portion configured to permit a hand of the shopper to pass and to thereafter manipulate positions of the shelf contained product, wherein the plurality of one product movement apertures are smaller than the at least one product exit aperture.

11. The storefront shelf of claim 10, wherein the front portion further comprising:

a set of restocking components connected to open and close the continuous transparent barrier, wherein when the continuous transparent barrier is open the shelf contained products are configured to be restocked via the opening.

12. The storefront shelf of claim 10, further comprising:

a shelf top coupled to the front portion;

a shelf bottom;

a right sidewall coupled to the shelf top and the shelf bottom;

a left sidewall coupled to the shelf top and the shelf bottom; and a rear sidewall coupled to at least the shelf top and the shelf bottom.

13. The storefront shelf of claim 12, wherein the front portion, shelf top, shelf bottom, right sidewall, the left sidewall, and the rear sidewall define a shelf storage volume within which shelf contained products are contained, wherein the at least one product exit aperture is an exit void configured to permit the shelf contained products to be individually moved from the shelf storage volume to an outside environment, said exit void configured to prevent two shelf contained products from concurrently fitting through the exit void, wherein when the front portion is closed, the at least one product exit aperture is the only opening configured to permit any of the shelf contained products to be individually moved from the shelf storage volume to the outside environment.

14. The storefront shelf of claim 13, wherein each of the product movement apertures is an aperture void configured to permit the hand to pass from outside the shelf storage volume into the shelf storage volume and to positionally move the shelf contained products within the shelf storage volume, wherein in aggregate the product movement apertures are configured to permit movements of all of the shelf contained products from an arbitrary initial position within the shelf storage volume to a position immediately proximate to the product exit aperture such that any of the respective shelf contained products so moved is able to be extracted to the outside environment through the product exit aperture by movements of the shopper's hand as it extends into the shelf storage volume via one of the product movement apertures.

15. The storefront shelf of claim 13, wherein the continuous transparent barrier is a polycarbonate plastic.

16. The storefront shelf of claim 13, wherein each of the product apertures are circles, evenly spaced from one another in in a horizontal line along the continuous transparent barrier.

17. The storefront shelf of claim 13, wherein the storefront shelf comprises two product exit apertures, which consist of a right side exit aperture and a left side exit aperture.

18. The storefront shelf of claim 13, wherein the continuous transparent barrier comprises two panes, each of which are configured to open by sliding along rails of the storefront shelf, wherein the shorefront shelf further comprises a locking mechanism for positionally locking the two panes when closed.

19. A storefront shelf comprising:

a shelf front, which is substantially planar comprising:

a continuous transparent barrier coupled to the shelf front, the continuous transparent barrier configured to permit shoppers to view shelf contained products and further configured to inhibit extraction of any of a set of shelf contained products except through at least one product exit aperture of the shelf front;

a plurality of product movement apertures disposed in the continuous transparent barrier;

the at least one product exit aperture, which is an opening in the shelf front configured to permit a hand of a shopper to pass therethrough; and a set of restocking components connected to open and close the continuous transparent barrier, wherein when the continuous transparent barrier is open the shelf contained products are able to be restocked via the opening;

a shelf top;

a shelf bottom;

a right sidewall;

a left sidewall; and a rear sidewall;

wherein the shelf front, shelf top, shelf bottom, right sidewall, the left sidewall, and the rear sidewall define a shelf storage volume within which shelf contained products are contained, wherein when the shelf front is closed, the at least one product exit aperture is the only opening configured to permit any of the shelf contained products to be moved from the shelf storage volume to an outside environment, and wherein the plurality of product movement apertures are smaller than the at least one product exit aperture.

* * * * *